US007311018B1

(12) United States Patent
Liou

(10) Patent No.: US 7,311,018 B1
(45) Date of Patent: Dec. 25, 2007

(54) WRENCH

(76) Inventor: Mou-Tang Liou, No. 25, Lane 86, Ta Wei Road, Ta Li City, Taichung Hsien (TW)

( * ) Notice: Subject to any disclaimer, the term of this patent is extended or adjusted under 35 U.S.C. 154(b) by 0 days.

(21) Appl. No.: 11/470,000

(22) Filed: Sep. 5, 2006

(51) Int. Cl.
*B25B 13/46* (2006.01)
*B25B 23/16* (2006.01)

(52) U.S. Cl. ..... 81/60; 81/177.5; 81/177.7; 81/63.2

(58) Field of Classification Search ..... 81/60, 81/63.1, 63.2, 177.5, 177.7, 124.7, 177.9
See application file for complete search history.

(56) References Cited

U.S. PATENT DOCUMENTS 1,510,059 A * 9/1924 Holle ..... 81/62
2,701,977 A * 2/1955 Stone ..... 81/63.2
6,260,452 B1 * 7/2001 Yu ..... 81/177.9
6,739,222 B2 * 5/2004 Hsieh ..... 81/60
6,945,145 B1 * 9/2005 Kesinger ..... 81/487
7,040,200 B2 * 5/2006 Lin ..... 81/177.5
7,066,056 B1 * 6/2006 Hsieh ..... 81/63.2

FOREIGN PATENT DOCUMENTS

TW M283713 12/2005

* cited by examiner

*Primary Examiner*—Hadi Shakeri
(74) *Attorney, Agent, or Firm*—Alan Kamrath; Kamrath & Associates PA

(57) ABSTRACT

A wrench includes a handle, a joint movably mounted on the handle and a working unit pivotally connected to the joint. The handle pivots relative to the working unit between a first position, where the handle and the working unit extend perpendicular to each other, and a second position, where the handle and the working unit extend along a same axis.

33 Claims, 15 Drawing Sheets

3 – 3

4 – 4

5 – 5

10 – 10

WRENCH

BACKGROUND OF INVENTION

1. Field of Invention

The present invention relates to a wrench and, more particularly, to a wrench that can be operated in a narrow and deep space.

2. Related Prior Art

Disclosed in Taiwanese Patent M283713 is a wrench including a body 10 and a lever 11 inserted through the body 10 in a radial direction. The lever 11 is long and hence provides a significant mechanical gain. However, as the body 10 and the lever 11 extend perpendicular to each other, the wrench cannot be used in a narrow and deep space such as what is found in the engine compartment of a vehicle.

The present invention is therefore intended to obviate or at least alleviate the problems encountered in the prior art.

SUMMARY OF INVENTION

According to the present invention, a wrench includes a handle, a joint movably mounted on the handle and a working unit pivotally connected to the joint so that that handle can be pivoted relative to the working unit between a first position where they extend perpendicular to each other and a second position where they extend along a same axis.

An advantage of the wrench according to the present invention is its operability in a narrow and deep space when the handle and the working unit extend along the same axis.

Another advantage of the wrench, according to the present invention, is its utility in various limited spaces, since the handle can be pivoted to various positions relative to the working unit.

Still another advantage of the wrench according to the present invention is easy and convenient operation.

Other advantages and features of the present invention will become apparent from the following description referring to the drawings.

BRIEF DESCRIPTION OF DRAWINGS

The present invention will be described via detailed illustration of five embodiments referring to the drawings.

DETAILED DESCRIPTION OF EMBODIMENTS

Figure 1:
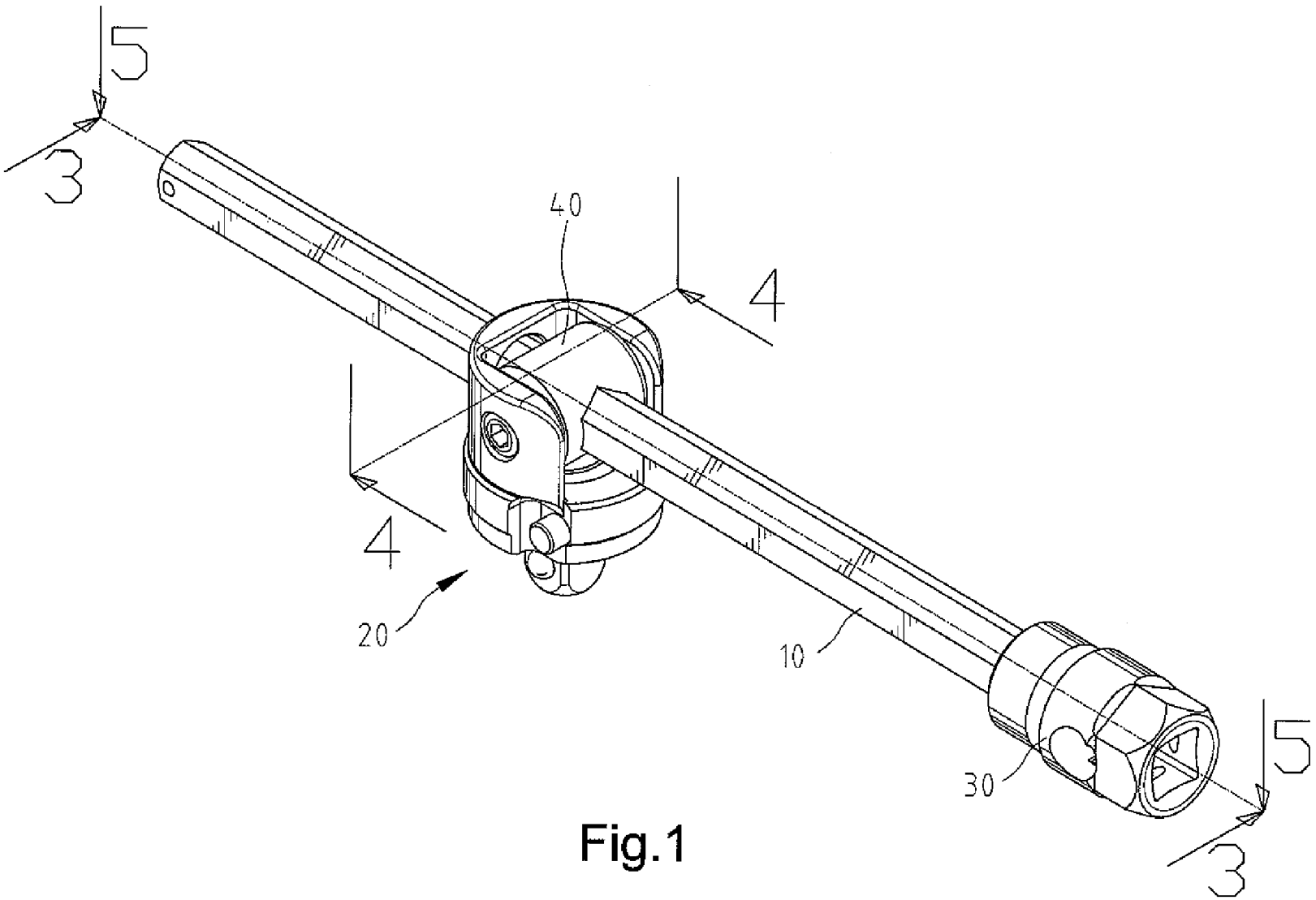
FIG. 1 is a perspective view of a wrench according to the first embodiment of the present invention.
Figure 2:
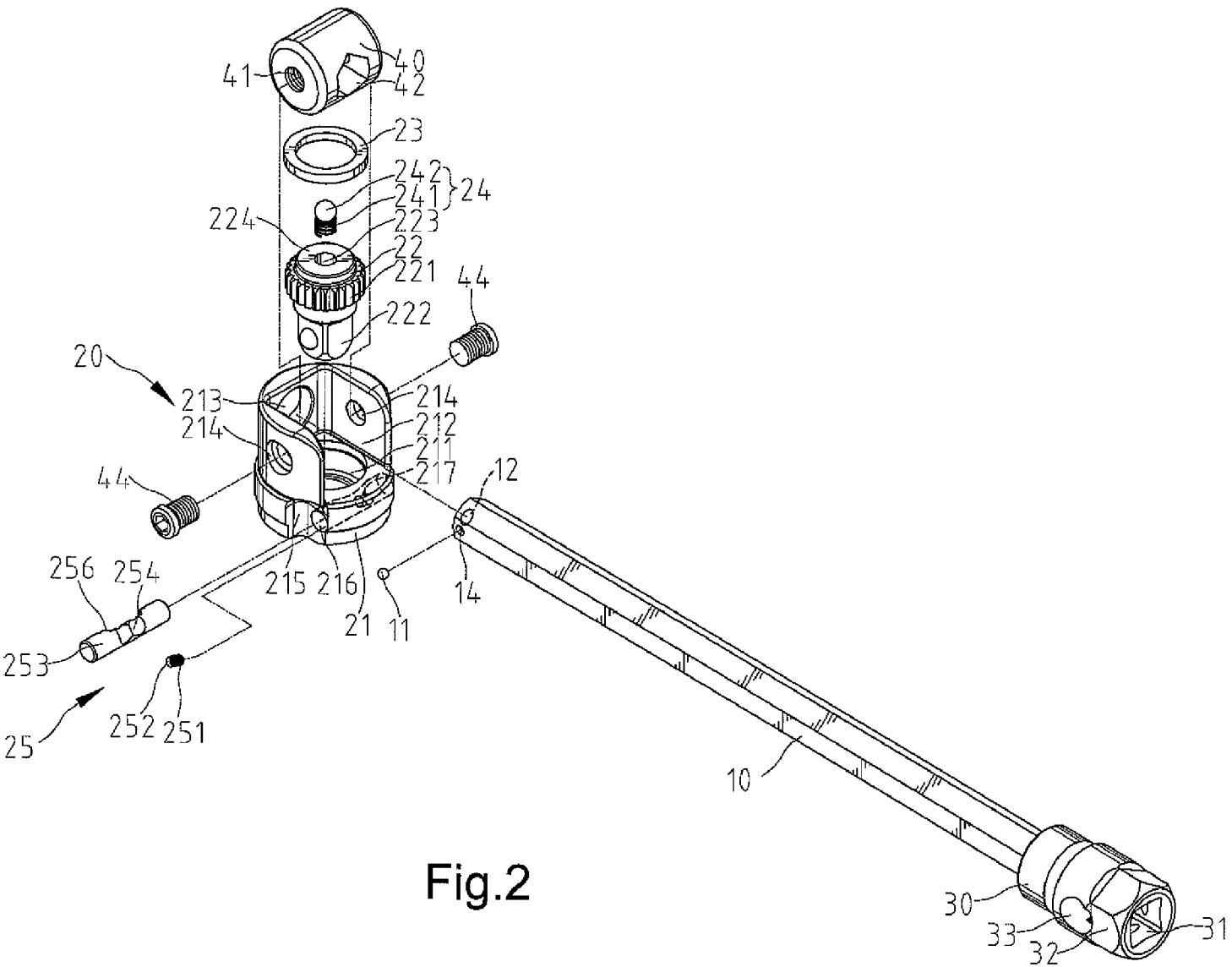
FIG. 2 is an exploded view of the wrench shown in FIG. 1.
Figure 3:
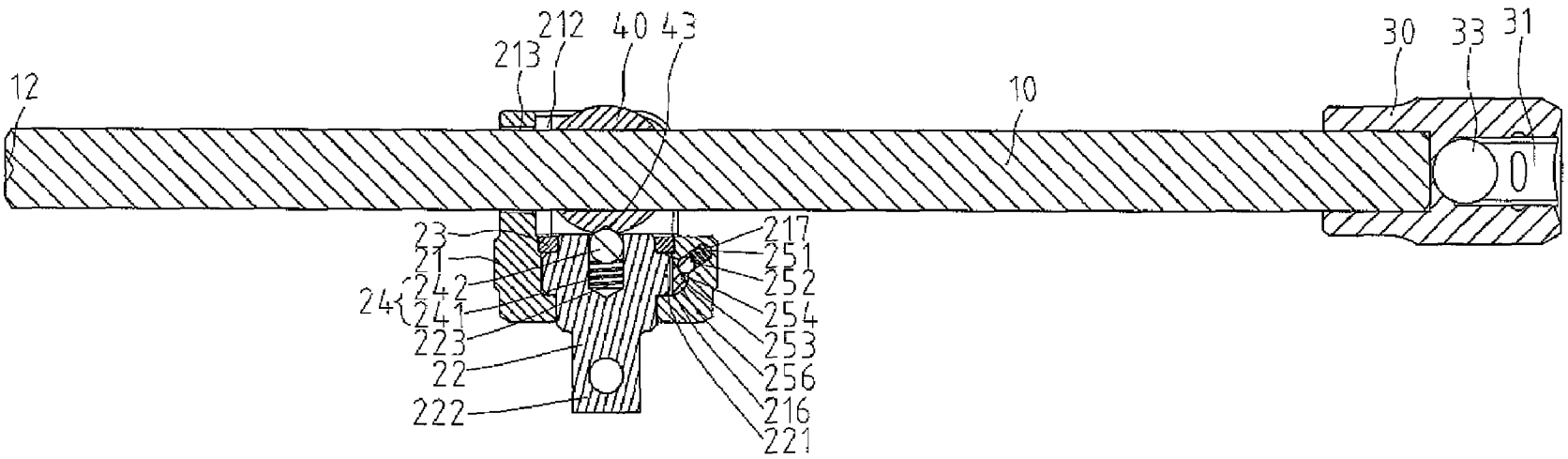
FIG. 3 is a cross-sectional view of the wrench taken along a line 3-3 shown in FIG. 1.
Figure 4:
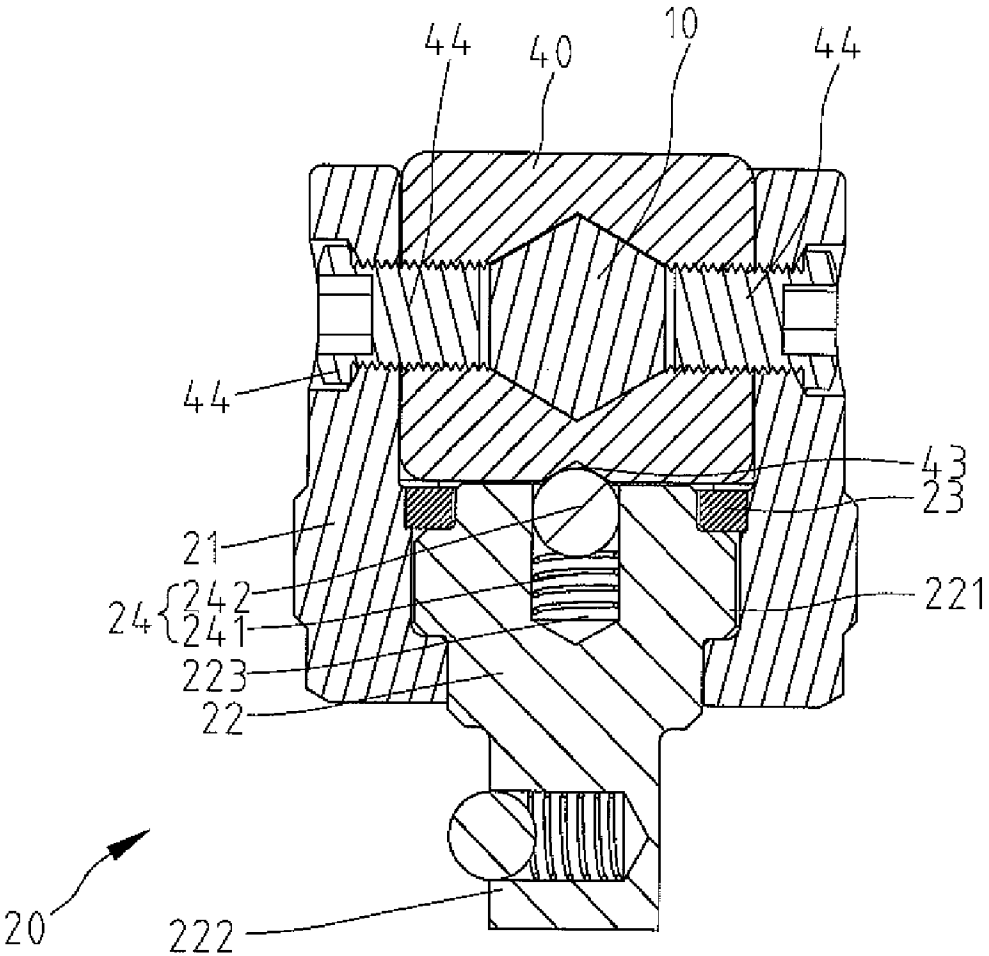
FIG. 4 is a cross-sectional view of the wrench taken along a line 4-4 shown in FIG. 1.

Referring to FIGS. 1 through 8, there is shown a wrench according to a first embodiment of the present invention. The wrench includes a handle 10, a joint 40 movably mounted on the handle 10, a first working unit 20 pivotally connected to the joint 40 and a second working unit 30 attached to or formed at the handle 10.

The handle 10 is a rectilinear element with a first end and a second end opposite to the first end. The handle defines a recess 12 in the first end and a recess 14 near the first end. After the joint 40 is mounted on the handle 10, a ball 11 is fit in the recess 14 to retain the joint 40 and hence the first working unit 20 on the handle 10. The handle 10 includes a hexagonal profile.

The second working unit 30 includes a hexagonal profile 32, a square hole 31 axially defined therein and an aperture 33 transversely defined therein. The square hole 31 can receive a square shank of a tool bit or a square insert of a T-bar. The aperture 33 can receive an auxiliary handle so that the auxiliary handle is used as a lever while the handle 10 is used as an axle. The hexagonal profile 32 can be inserted in a hexagonal recess defined in a socket.

The joint 40 includes two screw holes 41 axially defined therein and a hexagonal aperture 42 transversely defined therein. The hexagonal aperture 42 compliantly receives the hexagonal profile of the handle 10. There is a shoulder 421 on the wall of the hexagonal aperture 42.

The first working unit 20 includes a head 21, a core 22, an annular restraint 23, a positioning device 24 and a switching device 25.

The head 21 includes a first portion and a second portion. The first portion of the head 21 is in the form of a ring, that is, it defines a circular space 211. The first portion of the head 21 defines two cutouts 215, a tunnel 216 and a recess 217. The tunnel 216 includes two ends, each in communication with a related one of the cutouts 215, and a middle point, in communication with the circular space 211. The recess 217 is in communication with the tunnel 216.

The second portion of the head includes two lateral walls opposite to each other and a font wall formed between the lateral walls. This configuration of the second portion of the head 21 supports a heavy load. However, the second portion of the head 21 may include only the lateral walls if the head 21 is used under a light load. A space 212 is defined by the walls of the second portion of the head 21. The font wall of the second portion of the head 21 defines an aperture 213 while each of the lateral walls of the second portion of the head 21 defines a countersink hole 214.

The switching device 25 includes an elastic element 251 inserted in the recess 217, a detent 252 biased by the elastic element 251 and a switch 253 movably inserted in the tunnel 216 and engaged with the detent 252. The switch 253 defines two recesses 254 on a side and two series of dents 256 on an opposite side.

The core 22 includes a square insert 222 formed at an end, a neck 224 formed at an opposite end and a series of teeth 221 formed between the square insert 222 and the neck 224. The neck 224 axially defines a recess 223.

The positioning device 24 includes an elastic element 241 inserted in the recess 223 and a detent 242 biased by the elastic element 241. The detent 242 can be inserted in the recess 43 for positioning the core 22 relative to the joint 40.

The series of teeth 221 and the neck 224 are inserted in the circular space 211 while the square insert 222 is exposed from the head 21. The annular restraint 23 is fit in the circular space 211, around the neck 224 and against the series of teeth 221 so that the core 22 is retained in the head 21. The annular restraint 23 may be a bearing for ensuring smooth rotation of the core 22 in the head 21.

Two fasteners 44, such as threaded bolts, are driven in the screw holes 41 through the countersink holes 214 for pivotally connecting the joint 40 to the head 21.

A selected one of the recesses 254 receives the detent 252 for retaining the switch 253 in a selected one of two positions. Thus, a related one of the series of dents 256 receives the series of teeth 221 so that the head 21 drives the core 22 in a related one of two directions because of the switch 253.

Figure 5:
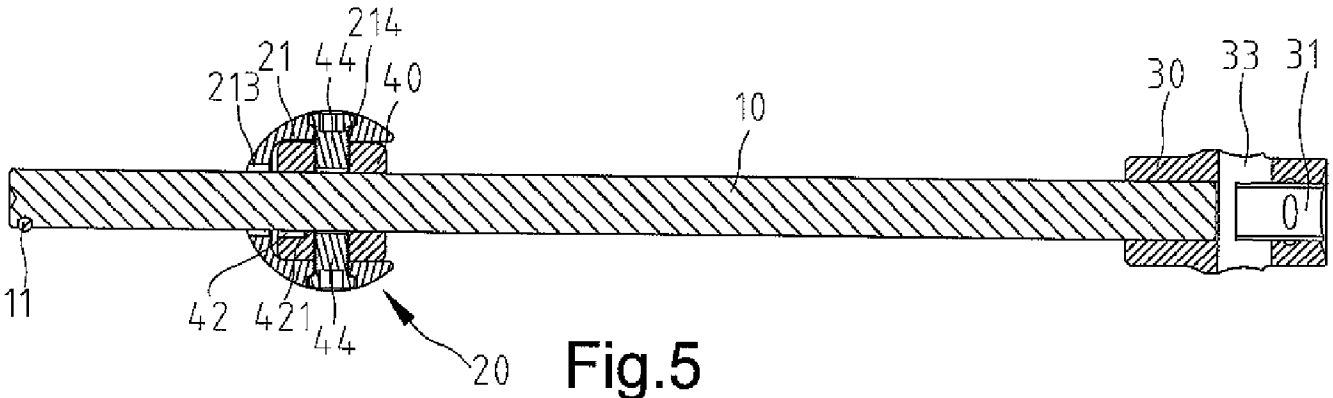
FIG. 5 is a cross-sectional view of the wrench taken along a line 5-5 shown in FIG. 1.

Referring to FIG. 5, the joint 40, and hence the first working unit 20, are movable along the handle 10. The handle 10 is inserted through the aperture 213.

Figure 6:
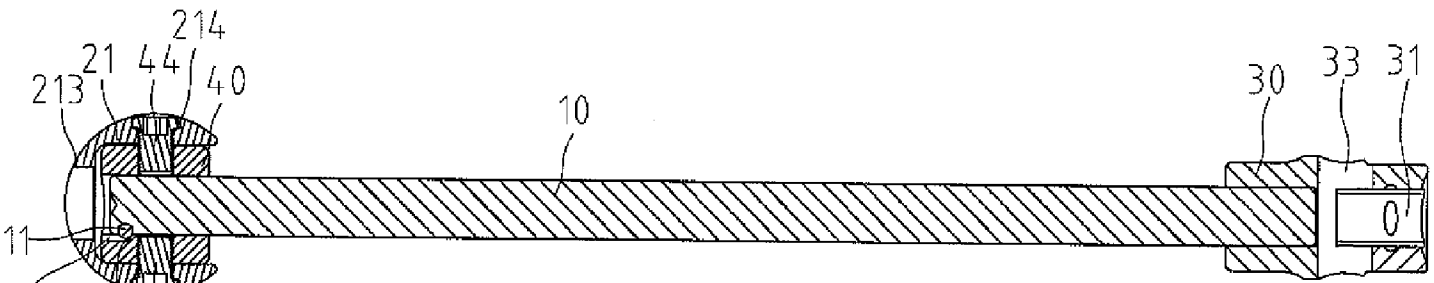
FIG. 6 is a cross-sectional view of the wrench in another position than shown in FIG. 5.

Referring to FIG. 6, the shoulder 421 is located against the ball 11 so that the joint 40 and hence the first working unit 20 are retained on the handle 10.

Figure 7:
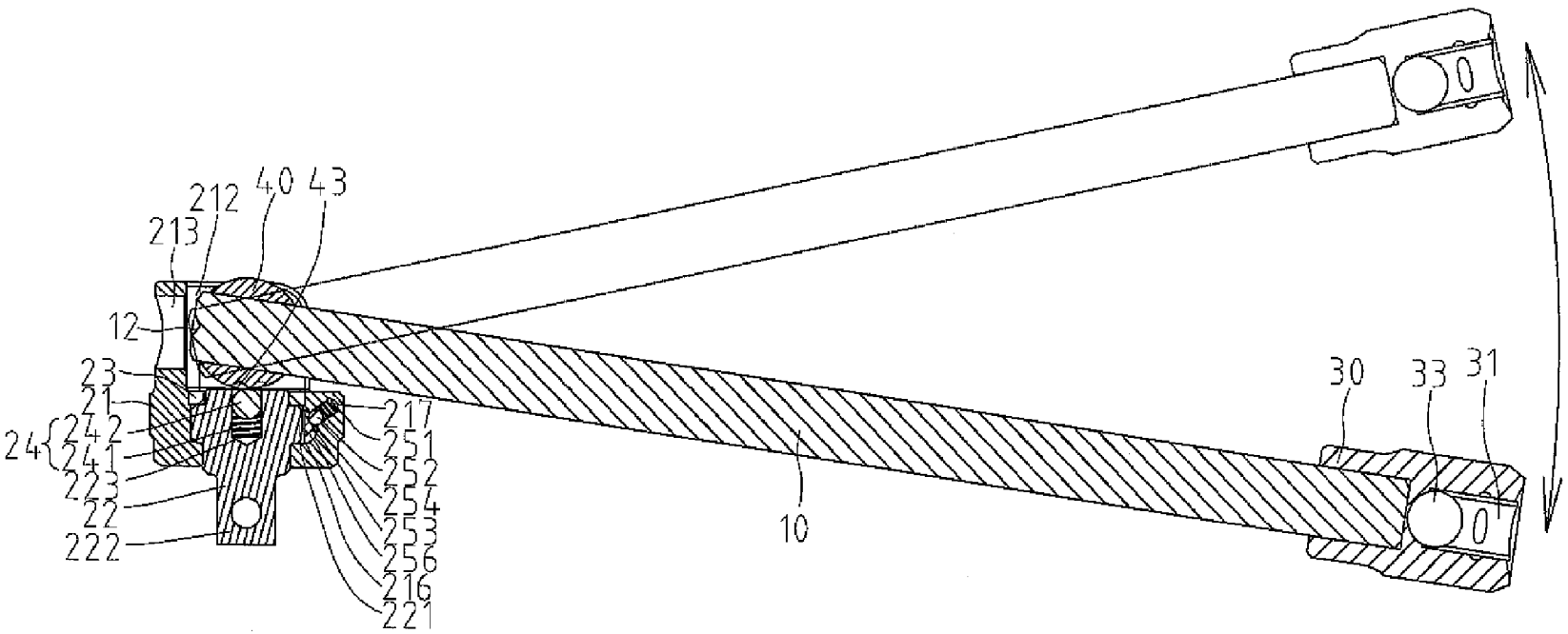
FIG. 7 is a cross-sectional view of the wrench pivoted between other positions than shown in FIG. 3.

Referring to FIG. 7, the handle 10 can be pivoted to various positions relative to the first working unit 20 because of the joint 40. In these positions, the handle 10 is used as a lever.

Figure 8:
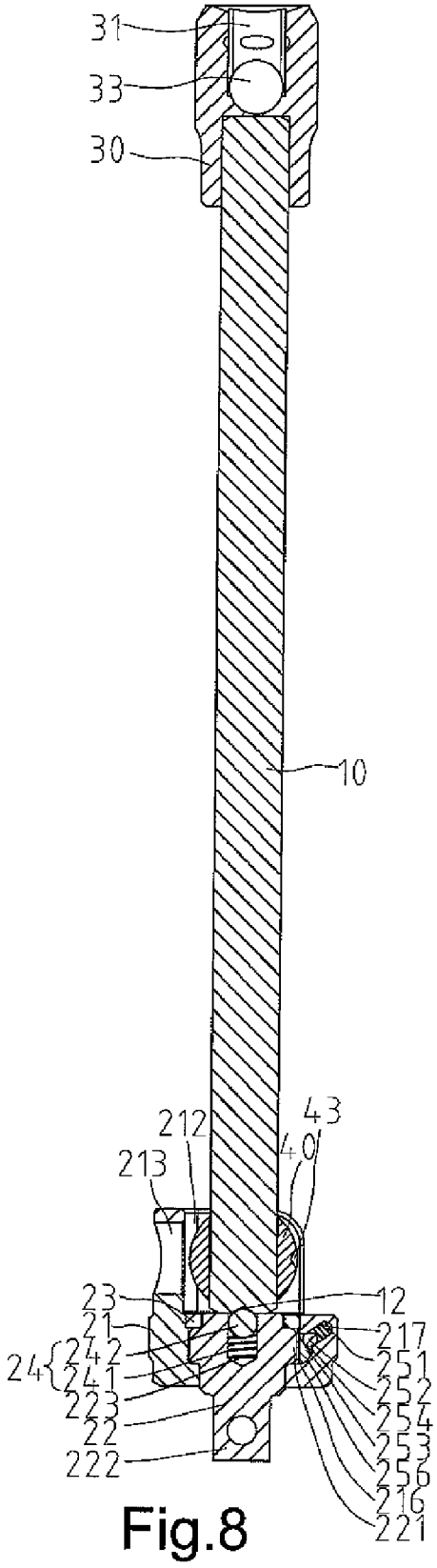
FIG. 8 is a cross-sectional view of the wrench pivoted to another position than shown in FIG. 3.

Referring to FIG. 8, the handle 10 and the core 22 extend in a same axis. In this position, the handle 10 is used as an axle while the auxiliary handle is used as a lever. In this position, the wrench can be operated in a narrow and deep space such as that found in an engine compartment of a vehicle.

Figure 9:
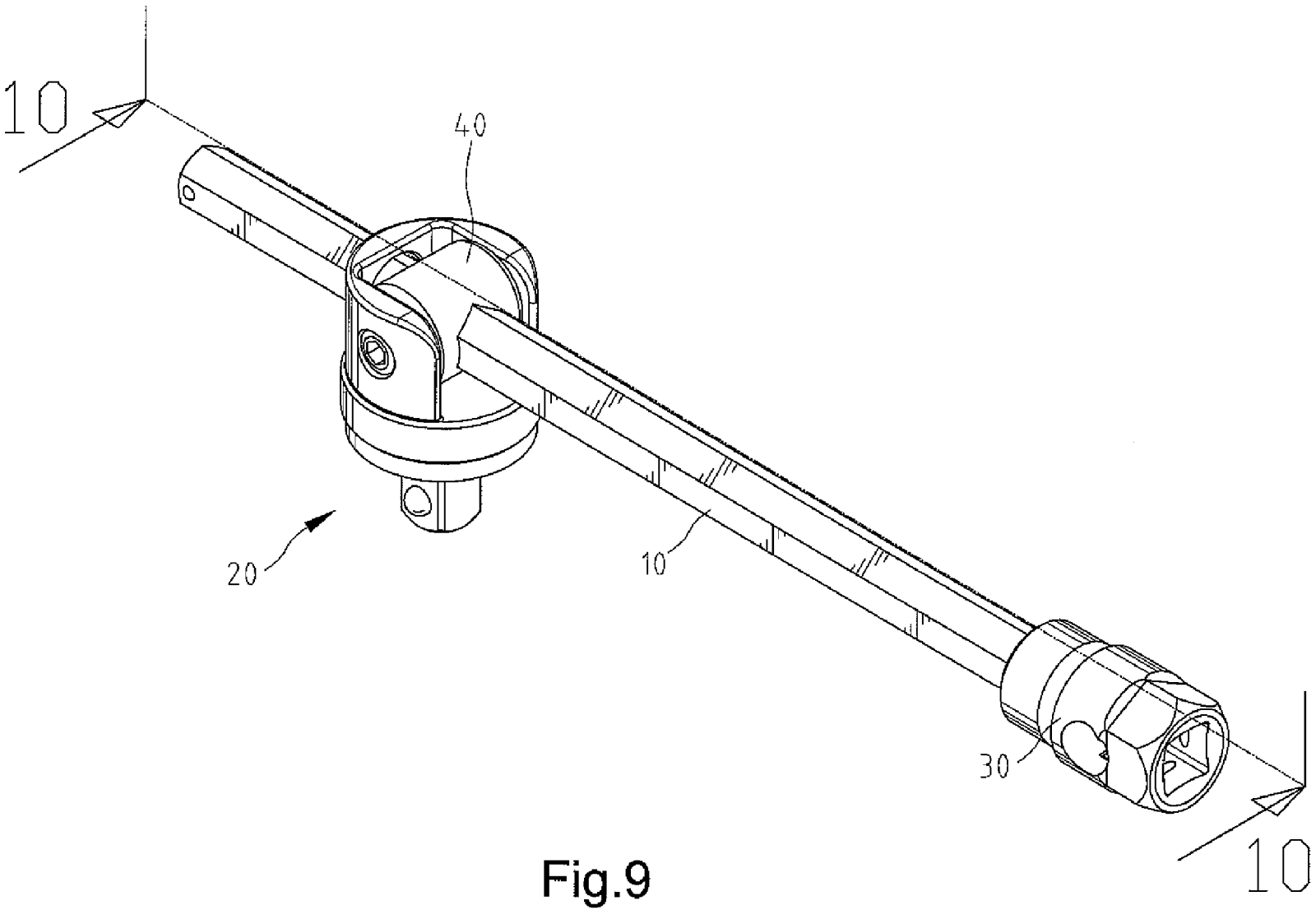
FIG. 9 is a perspective view of a wrench according to the second embodiment of the present invention.
Figure 10:
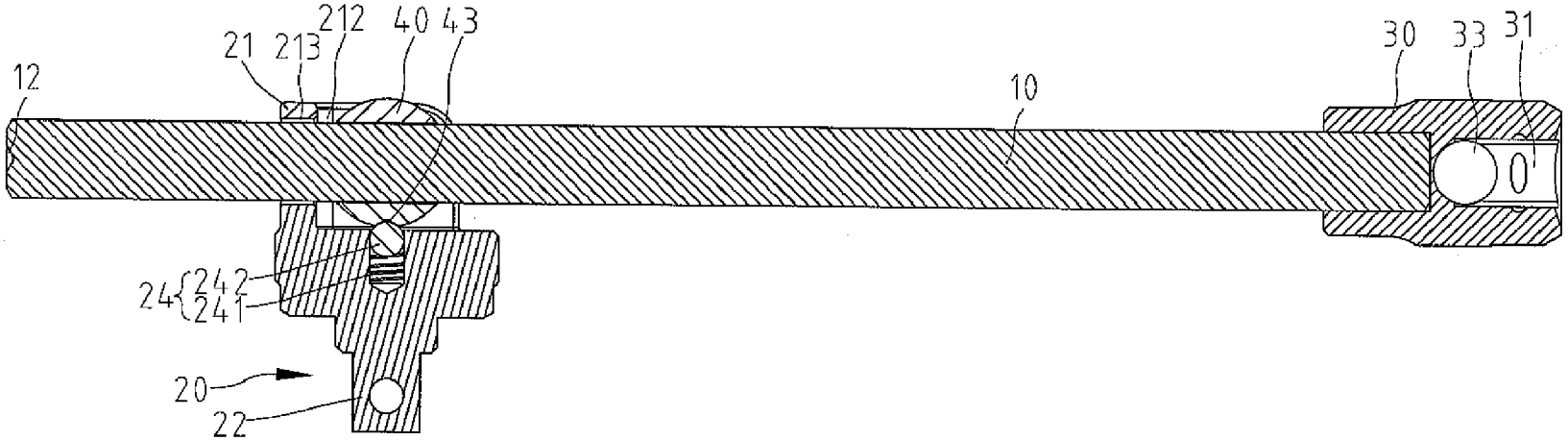
FIG. 10 is a cross-sectional view of the wrench taken alone a line 10-10 shown in FIG. 1.

Referring to FIGS. 9 and 10, a wrench is shown according to a second embodiment of the present invention. The second embodiment is like the first embodiment except that the head 21 and the core 22 are made into a single piece. Accordingly, the circular space 211, the cutouts 215, the tunnel 216 and the recess 217 are omitted from the head 21, the series of teeth 221 is omitted from the core 22, and the switching device 25 is omitted from the first working unit 20.

Figure 11:
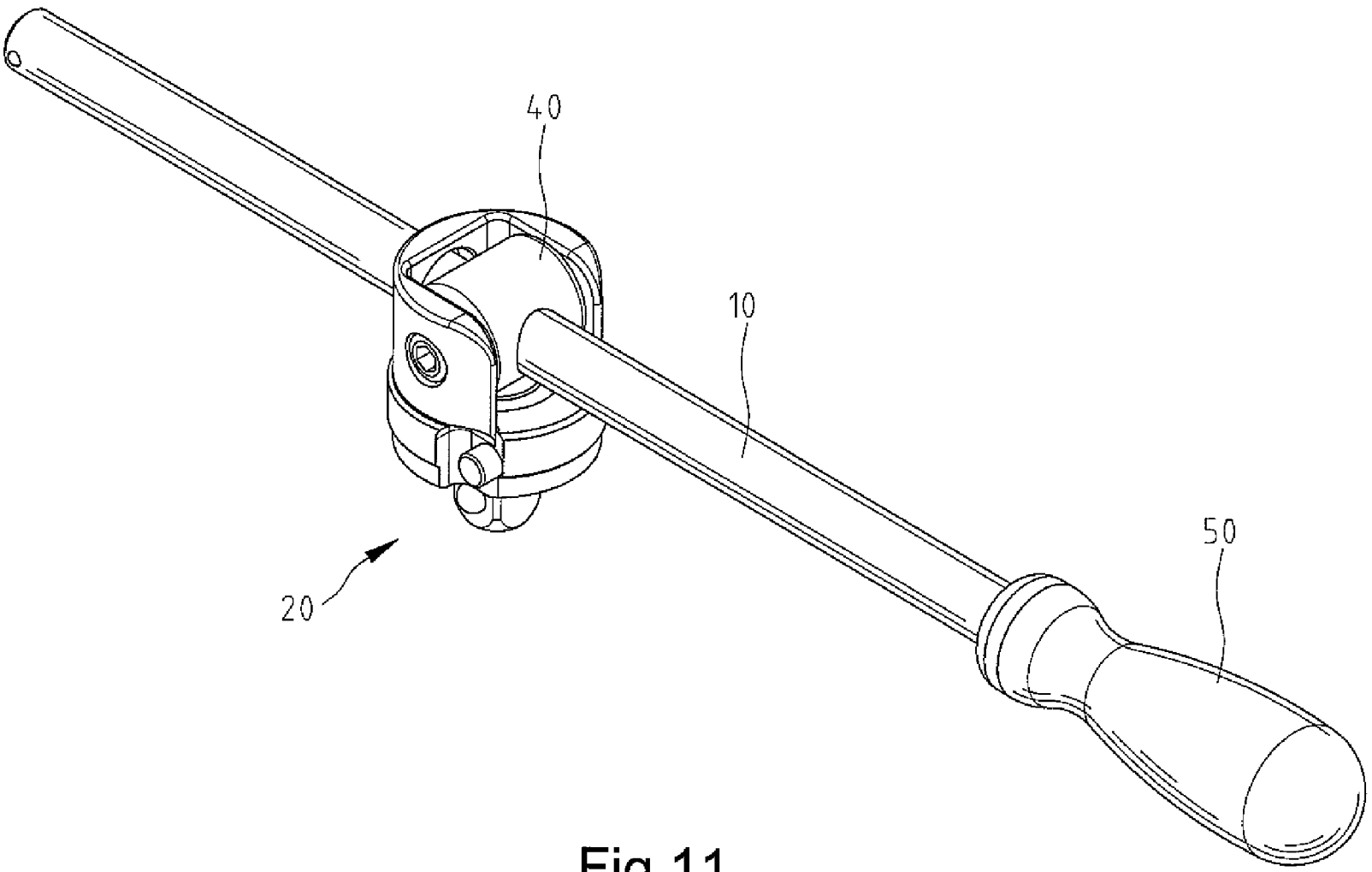
FIG. 11 is a perspective view of a wrench according to the third embodiment of the present invention.

Referring to FIG. 11, a wrench is shown according to a third embodiment of the present invention. The third embodiment is like the first embodiment except including a grip 50 instead of the second working unit 30.

Figure 12:
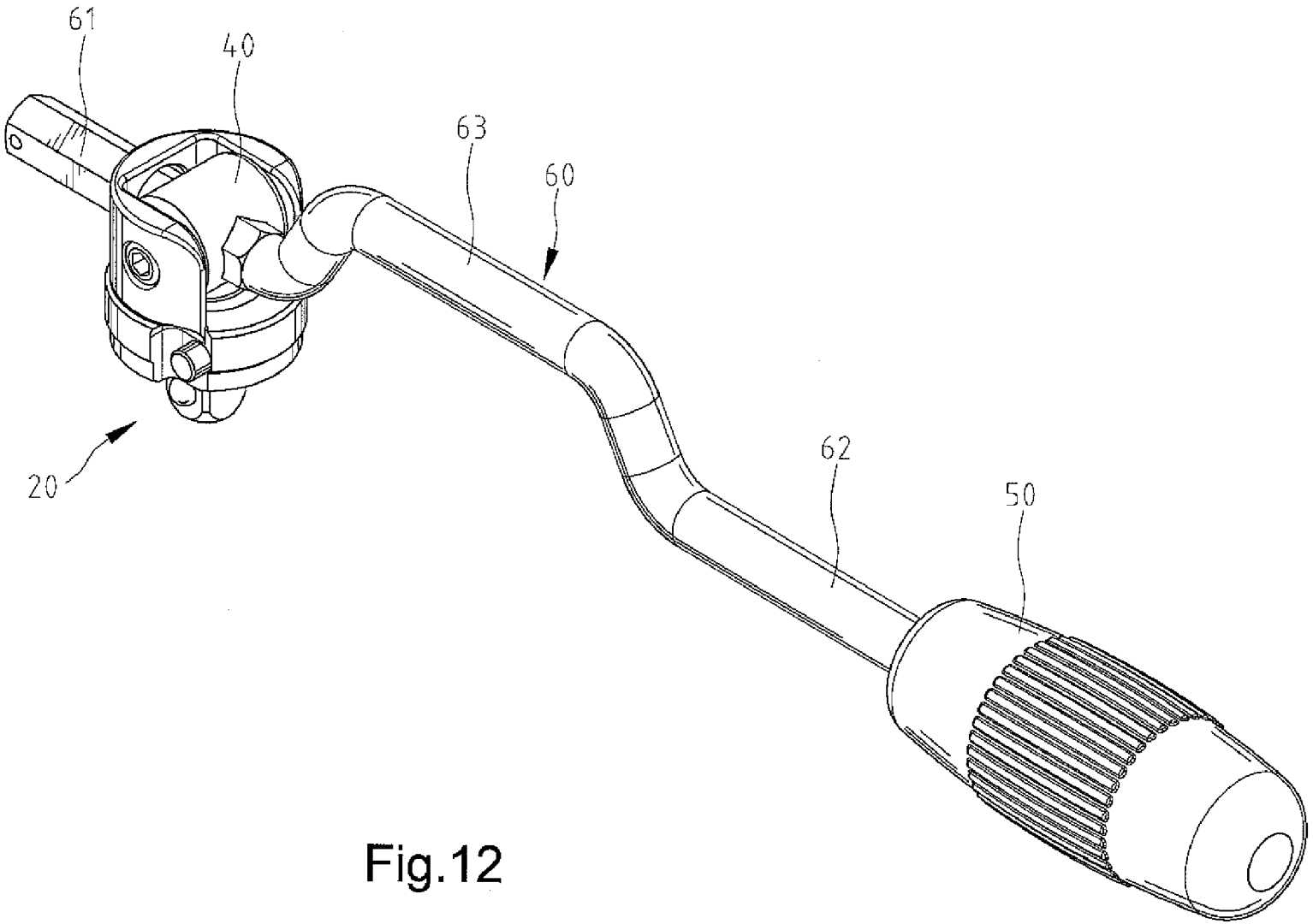
FIG. 12 is a perspective view of a wrench according to the fourth embodiment of the present invention.
Figure 13:
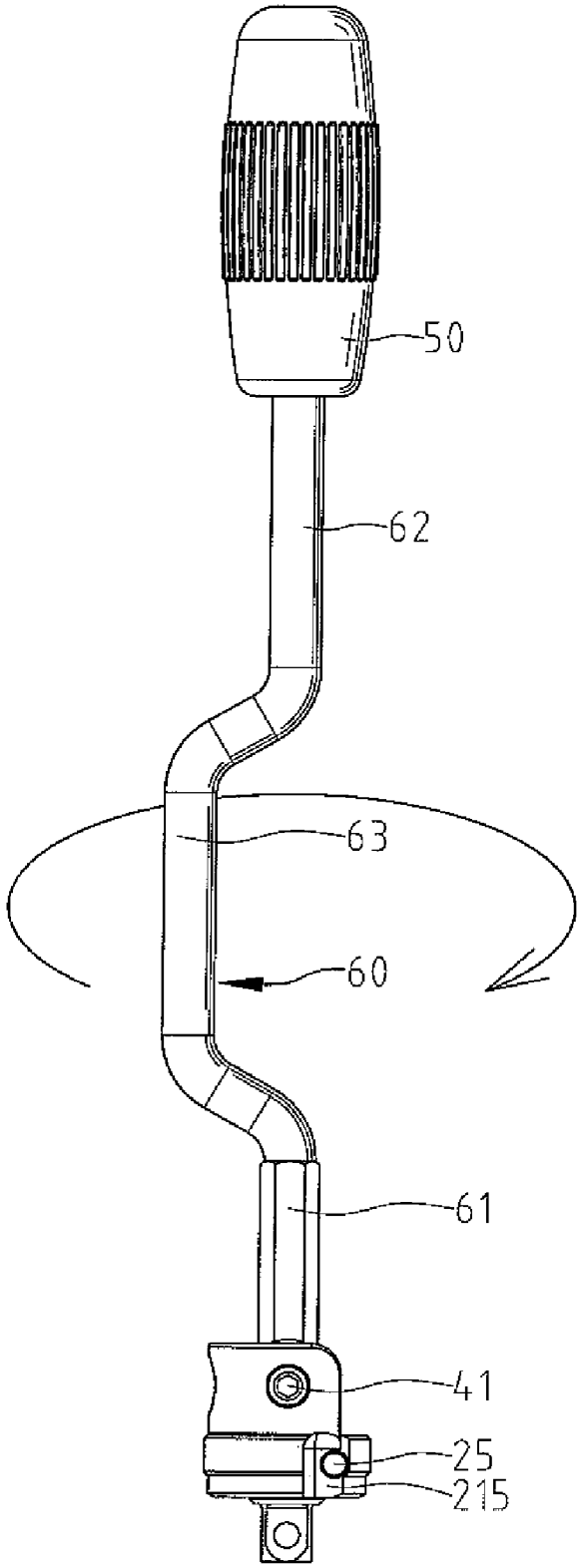
FIG. 13 is a side view of the wrench shown in FIG. 12.

Referring to FIGS. 12 and 13, a wrench is shown according to a fourth embodiment of the present invention. The fourth embodiment is like the third embodiment except including a handle 60 instead of the handle 10. The handle 60 is in the form of a crank shaft, that is, it includes a hexagonal portion 61 inserted in the hexagonal aperture 42, a circular portion 62 rotationally inserted in the grip 50 and a crank 63 between the hexagonal portion 61 and the circular portion 62.

Figure 14:
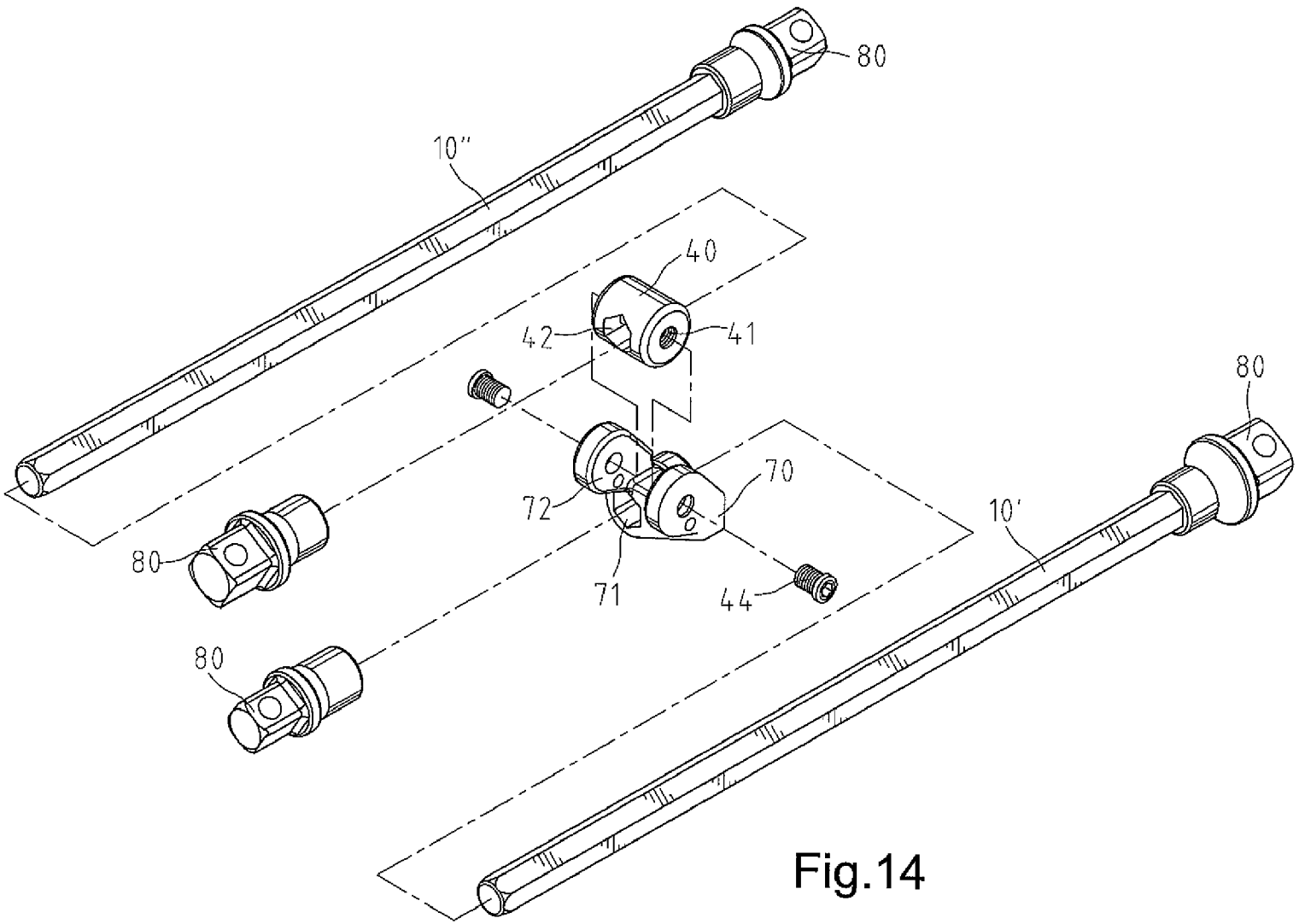
FIG. 14 is an exploded view of a wrench according to the fifth embodiment of the present invention.
Figure 15:
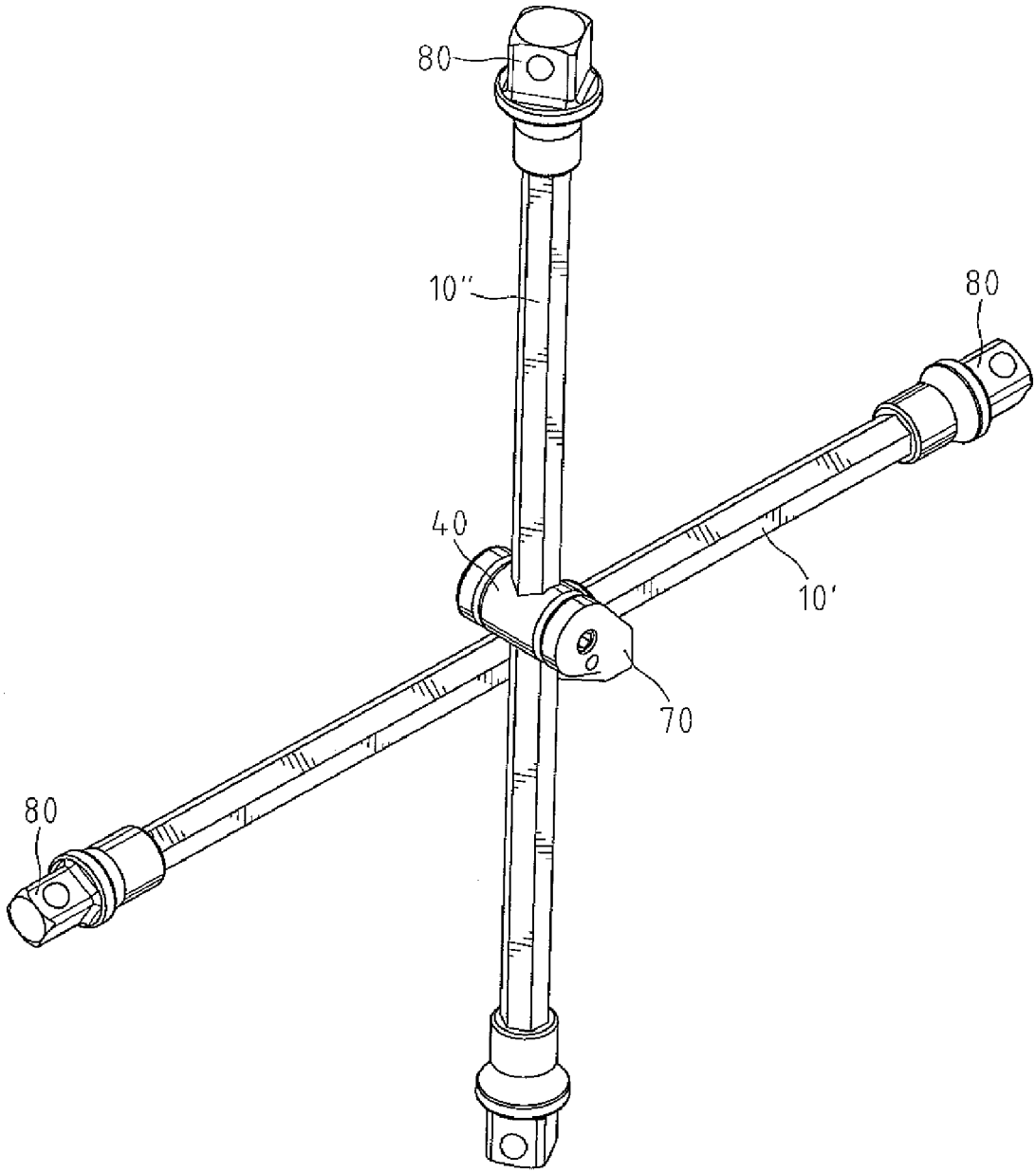
FIG. 15 is a perspective view of the wrench shown in FIG. 14.
Figure 16:
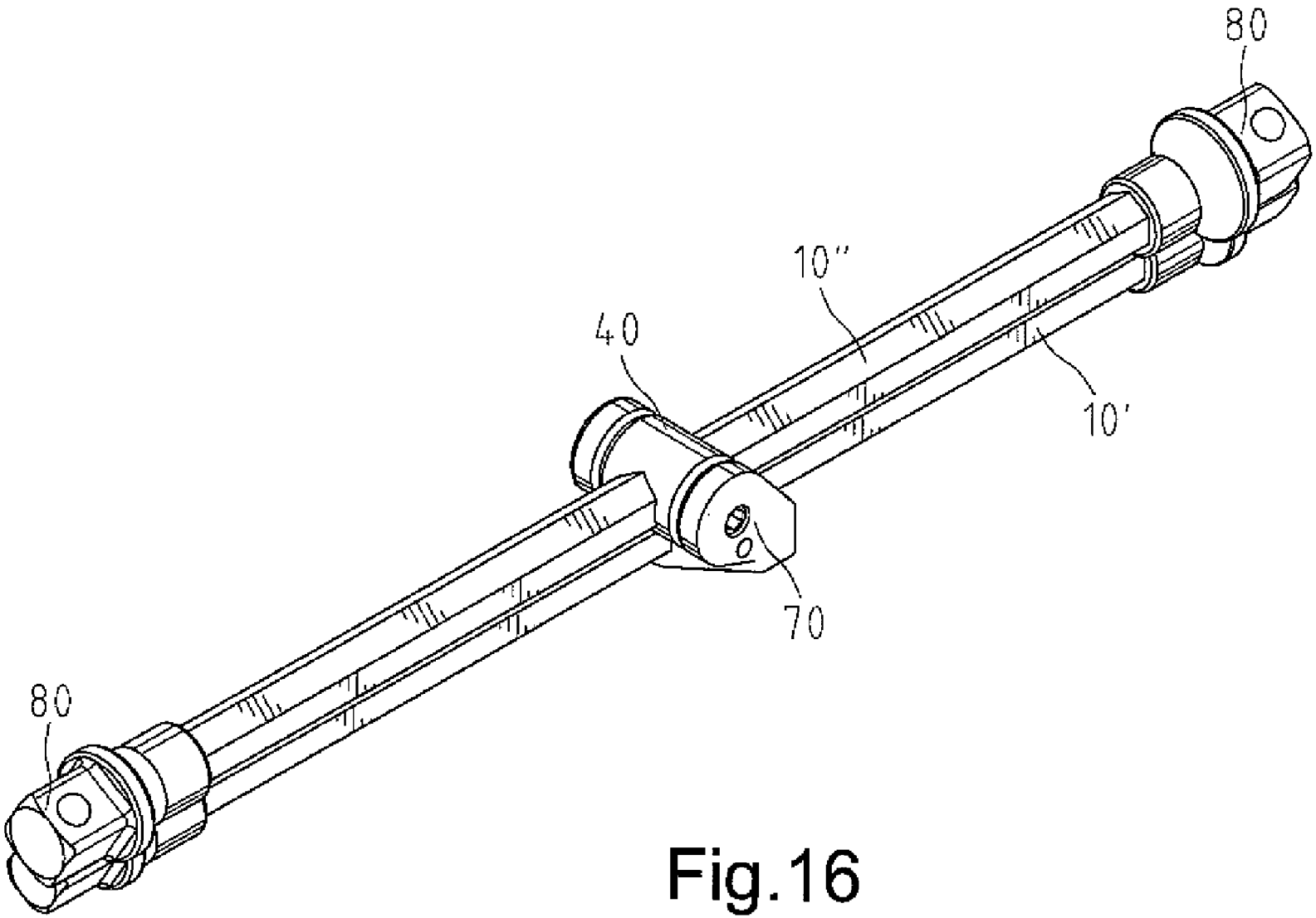
FIG. 16 is a perspective view of the wrench in another position than shown in FIG. 15.

Referring to FIGS. 14 through 16, a wrench is shown according to a fifth embodiment of the present invention. The wrench includes a first joint 70, a second joint 40 pivotally connected to the first joint 70, a first handle 10' movably connected to the first joint 70 and a second handle 10" movably connected to the second joint 40.

The first joint 70 includes a hexagonal aperture 71 defined therein and two ears 72 formed thereon. Each of the ears 72 defines an aperture. The second joint 40 includes two screw holes 41 axially defined therein and a hexagonal aperture 42 transversely defined therein. Two fasteners 44, such as threaded bolts, are driven in the screw holes 41 through the apertures of the ears 72 for pivotally connecting the second joint 40 to the first joint 70.

The first handle 10' includes a hexagonal profile for compliant insertion in the hexagonal aperture 71. A working unit 80 is attached to each end of the first handle 10'.

The first handle 10' includes a hexagonal profile for compliant insertion in the hexagonal aperture 42. A working unit 80 is attached to each end of the second handle 10'. Each of the working units is a one-piece element, that may be replaced with a selective one-way driving mechanism, including the first portion of the head 21, the core 22, the ring 23 and the switching device 25.

Referring to FIG. 15, the first handle 10' extends perpendicular to the second handle 10".

Referring to FIG. 16, the first handle 10' extends parallel to the second handle 10".

The wrench according to the present invention exhibits several advantages. Firstly, it can be operated in a narrow and deep space such as that is found in the engine compartment of the vehicle when the handle and the working unit extend along a same axis.

Secondly, it can be used in various spaces since the handle can be pivoted to various positions relative to the working unit.

Thirdly, it can be used easily and conveniently.

The present invention has been described via the detailed illustration of the embodiments. Those skilled in the art can derive variations from the embodiments without departing from the scope of the present invention. Therefore, the embodiments shall not limit the scope of the present invention defined in the claims.

What is claimed is:

1. A wrench comprising:

a first handle;

a first joint movably mounted on the first handle; and a working unit, with the working unit pivotally connected to the first joint, wherein the first handle pivots relative to the working unit between a first position where the first handle and the working unit extend perpendicular to each other and a second position where the first handle and the working unit extend along a same axis, wherein the working unit comprises a head pivotally connected to the first joint and a core connected to the head, wherein the core is rotationally connected to the head, wherein the working unit comprises a switching device movable between a first position where the head can drive the core in a first direction through the switching device and a second position where the head can drive the core in a second direction through the switching device, wherein the switching device comprises a switch made with two series of dents, wherein the core comprises a series of teeth for engagement with a selected one of the series of dents, and wherein the head defines a circular space and a tunnel in communication with the circular space so that the circular space receives the core and that the tunnel receives the switch.

2. The wrench according to claim 1 wherein the first handle comprises a non-circular profile, wherein the first joint defines a non-circular aperture for compliantly receiving the non-circular profile of the first handle.

3. The wrench according to claim 1 wherein the first joint comprises two fasteners driven in the first joint through the working unit.

4. The wrench according to claim 3 wherein the fasteners are threaded bolts.

5. The wrench according to claim 4 wherein the first joint defines two screw holes for receiving the threaded bolts.

6. The wrench according to claim 3 wherein the working unit defines a space and two holes in communication with the space so that the fasteners are driven in the first joint located in the space through the holes.

7. The wrench according to claim 6 wherein the fasteners are threaded bolts, wherein the holes are countersink holes corresponding to the threaded bolts.

8. The wrench according to claim 6 wherein the head defines an aperture in communication with the space so that the first handle is inserted through the aperture when the first joint is moved on the first handle.

9. The wrench according to claim 1 wherein the working unit comprises a non-circular insert.

10. The wrench according to claim 1 comprising a positioning device for positioning the core relative to the first joint.

11. The wrench according to claim 10 wherein the positioning device comprises a detent and an elastic element for biasing the detent, the first joint defines a recess for receiving the detent, and the core defines a recess for receiving the elastic element.

12. The wrench according to claim 1 comprising a restraint for keeping the core in the circular space.

13. The wrench according to claim 12 wherein the restraint is an annular restraint fit in the circular space, and the core comprises a neck inserted in the annular restraint.

14. The wrench according to claim 13 wherein the annular restraint is a bearing for ensuring smooth rotation of the core.

15. The wrench according to claim 1 comprising an auxiliary working unit attached to the first handle.

16. The wrench according to claim 1 comprising a grip attached to the first handle.

17. The wrench according to claim 16 wherein the first handle is rectilinear.

18. The wrench according to claim 16 wherein the first handle is in the form of a crankshaft.

19. The wrench according to claim 18 wherein the crankshaft comprises a circular portion rotationally connected to the grip.

20. The wrench according to claim 18 wherein the crankshaft comprises a crank.

21. The wrench according to claim 1 further comprising a second joint, with the second joint pivotally connected to the first joint, and a second handle movably connected to the second joint, with the first and second handles pivoted between a first position where they extend perpendicular to each other and a second position where they extend parallel to each other.

22. The wrench according to claim 21 wherein the second joint comprises two ears connected to the first joint.

23. The wrench according to claim 22 comprising two fasteners driven in the first joint through the ears of the second joint.

24. The wrench according to claim 22 wherein the fasteners are threaded bolts.

25. The wrench according to claim 24 wherein the first joint defines two screw holes for receiving the threaded bolts.

26. The wrench according to claim 21 wherein the first handle comprises a non-circular profile, wherein the first joint defines a non-circular aperture for compliantly receiving the non-circular profile of the first handle.

27. The wrench according to claim 21 wherein the second handle comprises a non-circular profile, wherein the second joint defines a non-circular aperture for compliantly receiving the non-circular profile of the second handle.

28. The wrench according to claim 21 comprising at least one working unit attached to the second handle.

29. The wrench according to claim 1 comprising a ball partially fit in a recess defined in the first handle for keeping the first joint on the first handle.

30. A wrench comprising:

a first handle;

a first joint movably mounted on the first handle;

a working unit, with the working unit pivotally connected to the first joint, wherein the first handle pivots relative to the working unit between a first position where the first handle and the working unit extend perpendicular to each other and a second position where the first handle and the working unit extend along a same axis, wherein the working unit comprises a head pivotally connected to the first joint and a core connected to the head, wherein the core is rotationally connected to the head, wherein the working unit comprises a switching device movable between a first position where the head can drive the core in a first direction through the switching device and a second position where the head can drive the core in a second direction through the switching device, wherein the switching device comprises a switch made with two series of dents, and wherein the core comprises a series of teeth for engagement with a selected one of the series of dents; and a positioning device for positioning the switch.

31. The wrench according to claim 30 wherein the switch defines two recesses, wherein the positioning device comprises a detent for insertion in a selected one of the recesses.

32. The wrench according to claim 31 wherein the positioning device comprises an elastic element for biasing the detent.

33. The wrench according to claim 32 wherein the head defines a circular space, a tunnel in communication with the circular space and a recess in communication with the tunnel so that the circular space receives the core, that the tunnel receives the switch and that the recess receives the elastic element.

* * * * *